US012534238B2

(12) United States Patent
Sinclair et al.

(10) Patent No.: US 12,534,238 B2
(45) Date of Patent: Jan. 27, 2026

(54) BOXING MACHINE

(71) Applicant: GRIPPLE AUTOMATION LIMITED, Sheffield (GB)

(72) Inventors: Ashley Sinclair, Sheffield (GB); Darren Beardsmore, Sheffield (GB)

(73) Assignee: GRIPPLE AUTOMATION LIMITED (GB)

( * ) Notice: Subject to any disclaimer, the term of this patent is extended or adjusted under 35 U.S.C. 154(b) by 109 days.

(21) Appl. No.: 18/702,580

(22) PCT Filed: Oct. 17, 2022

(86) PCT No.: PCT/IB2022/059931
§ 371 (c)(1),
(2) Date: Apr. 18, 2024

(87) PCT Pub. No.: WO2023/067469
PCT Pub. Date: Apr. 27, 2023

(65) Prior Publication Data

US 2025/0282506 A1 Sep. 11, 2025

(30) Foreign Application Priority Data

Oct. 19, 2021 (GB) ..... 2114889
Oct. 13, 2022 (GB) ..... 2215070

(51) Int. Cl.
*B65B 5/02* (2006.01)
*B65B 5/10* (2006.01)
(Continued)

(52) U.S. Cl.
CPC ..... *B65B 5/024* (2013.01); *B65B 5/106* (2013.01); *B65B 35/36* (2013.01); *B65B 35/50* (2013.01)

(58) Field of Classification Search
CPC ..... B65B 35/50; B65B 35/36; B65B 5/106; B65B 5/024
See application file for complete search history.

(56) References Cited

U.S. PATENT DOCUMENTS 3,201,912 A * 8/1965 Wozniak ..... B65B 5/06 53/505
3,826,058 A * 7/1974 Preisig ..... B65B 61/207 414/789.5

(Continued)

FOREIGN PATENT DOCUMENTS

EP 0734948 A1 10/1996

*Primary Examiner* — Himchan Song
(74) *Attorney, Agent, or Firm* — Clark Hill PLC; James R. Foley

(57) ABSTRACT

A boxing machine (1) comprises a first boxing station (100A) and a second boxing station (100B). The boxing machine (1) further comprises a product conveyor (200) extending from a product inlet (202) to the first boxing station (100A) and from the first boxing station (100A) to the second boxing station (100B). The boxing machine (1) further comprises a box conveyor (300) extending from a box inlet (302) to the first boxing station (100A) and from the first boxing station (100A) to the second boxing station (100B). The first boxing station (100A) is configured to insert a first set of products (2) from the product conveyor (200) to a sideways-oriented box (3) on the box conveyor (300). The second boxing station (100B) is configured to insert a second set of products (2) to the sideways-oriented box (3) on the box conveyor (300).

19 Claims, 4 Drawing Sheets

(51) Int. Cl.
*B65B 35/36* (2006.01)
*B65B 35/50* (2006.01)

(56) References Cited

U.S. PATENT DOCUMENTS 4,385,482 A * 5/1983 Booth ..... B65B 43/56 53/247
4,421,229 A * 12/1983 Pan ..... B65D 5/5445 229/120.32
4,815,251 A * 3/1989 Goodman ..... B65B 5/061 53/238
5,241,806 A * 9/1993 Ziegler ..... B65B 35/405 53/566
5,437,143 A * 8/1995 Culpepper ..... B65B 35/50 53/157
5,477,655 A * 12/1995 Hawley ..... B65B 35/405 53/251
5,727,365 A * 3/1998 Lashyro ..... B65B 61/207 53/238
5,758,474 A * 6/1998 Ziegler ..... B65B 35/50 53/566
5,771,658 A * 6/1998 Olson ..... B65B 35/54 53/238
6,711,878 B1 * 3/2004 Paselsky ..... B65B 5/106 53/251
7,219,485 B2 * 5/2007 Battisti ..... B65B 5/105 53/448
8,997,438 B1 * 4/2015 Fallas ..... B25J 9/0093 901/17
10,086,510 B1 * 10/2018 McAninch ..... B65B 35/24
2005/0144912 A1 * 7/2005 Prakken ..... B65B 35/50 53/247
2009/0013641 A1 * 1/2009 Prakken ..... B65B 35/50 53/284.5
2016/0304225 A1 * 10/2016 Monti ..... B65B 61/20
2019/0084701 A1 3/2019 Sassi
2024/0017866 A1 * 1/2024 Salvato ..... B65B 5/06
2025/0187847 A1 * 6/2025 Pain Solano ..... B65G 47/30

* cited by examiner

BOXING MACHINE

RELATED/PRIORITY APPLICATION

This application is a National Phase filing regarding International Application No. PCT/IB2022/059931, filed on Oct. 17, 2022, which relies upon Great Britain Application No. 2114889.5, filed on Oct. 19, 2021, and Great Britain Application No. 2215070.0, filed on Oct. 13, 2022, for priority.

FIELD OF THE INVENTION

Embodiments of the present invention relate to a boxing machine. In particular, but not exclusively, they relate to a boxing machine for inserting multiple products into boxes.

BACKGROUND TO THE INVENTION

Boxing machines for inserting multiple products into boxes are known. Such machines are also referred to as end of line packaging machines.

It is challenging to design a boxing machine that can operate at a high speed without frequent jams.

BRIEF DESCRIPTION OF VARIOUS EMBODIMENTS OF THE INVENTION

According to an aspect of the invention there is provided a boxing machine comprising:

a first boxing station;

a second boxing station;

from the first boxing station to the second boxing station; and a box conveyor extending from a box inlet to the first boxing station and from the first boxing station to the second boxing station, wherein the first boxing station is configured to insert a first set of products from the product conveyor to a sideways-oriented box on the box conveyor, and wherein the second boxing station is configured to insert a second set of products to the sideways-oriented box on the box conveyor.

An advantage of side-filling of each box, split between two boxing stations, is that the boxing machine is able to operate at a much higher speed.

The additional optional features mentioned below further enable the boxing machine to operate at a high speed without frequent jams.

The first boxing station may be configured to insert a plurality of accumulated products, collectively defining the first set of products, into the box. The second boxing station may be configured to insert a plurality of accumulated products, collectively defining the second set of products, into the box.

The second boxing station may be configured to stack the second set of products onto the first set of products within the sideways-oriented box. A product insertion height of the second boxing station may be higher than a product insertion height of the first boxing station, so that when the box is sideways-oriented the second set of products is stacked on the first set of products and when the box is upright-oriented the second set of products is alongside the first set of products.

Each boxing station may comprise a robotic picker. The robotic picker may comprise an end effector arrangement configured to pick products from the product conveyor.

The end effector arrangement may be sized to pick a plurality of products at once. The end effector arrangement may be configured as an array. The end effector arrangement may comprise vacuum means or other effector means, such as an array of vacuum end effectors for picking a plurality of products at once.

The robotic picker may comprise a parallel manipulator. An advantage is fast and stable operation Each boxing station may comprise a product accumulator. The product accumulator may comprise a platform between the product conveyor and the box conveyor. The robotic picker may be configured to pick at least one product from the product conveyor and place the product on the product accumulator. The picking may comprise lifting and the placing may comprise lowering. The robotic picker may be configured to assemble the respective first or second set of products on the product accumulator.

The robotic picker may be configured to pick one or more further products from the product conveyor and place the one or more further products adjacent the placed product(s) to form an array or a row or a column.

The robotic picker may be configured to stack additional products on the array or row or column, such that the first set of products is a stack and the second set of products is a stack. The stack can then be inserted into the box.

Each boxing station may comprise an inserter configured to laterally move the respective first or second set of products into the sideways-oriented box.

The inserter may be configured as a stack inserter configured to insert an entire stack of products into the box at once (e.g., in one movement). The inserter may be configured as a multiple-stack inserter configured to insert multiple adjacent stacks of products into the box at once.

The inserter may be configured to slide the respective first or second set of products into the box. The inserter may comprise a lateral pusher for pushing the respective first or second set of products laterally into the box.

The inserter may be configured to move from a starting position towards the box in a first path and then to return to the starting position in a second path bypassing a placing location of the robotic picker. This provides a speed advantage because the next sets of products can be assembled while the inserter is returning to its starting position.

The inserter may be configured to move within a channel defined by the product accumulator. The product accumulator may comprise guide portions, such as walls, defining the channel, the channel extending towards the box conveyor.

The boxing machine may comprise a control system. The control system may control various functions.

The control system may be configurable to control filling of boxes with an odd number of products. In said configuration, the control system may be configured to select alternating ones of the first boxing station and the second boxing station, for each boxing cycle, to provide an additional product (the odd-numbered product) to each successive box. An advantage of the alternating selection is increased speed (when measured over multiple boxing cycles) due to the avoidance of cumulative dwell time of one of the boxing stations.

The boxing machine may comprise a box folding system configured to fold a base of the box upstream of the first boxing station and configured to fold a top of the box downstream of the second boxing station.

The product conveyor and the box conveyor may be substantially parallel to each other. The box may be oriented so that an opening of the box faces the product conveyor.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
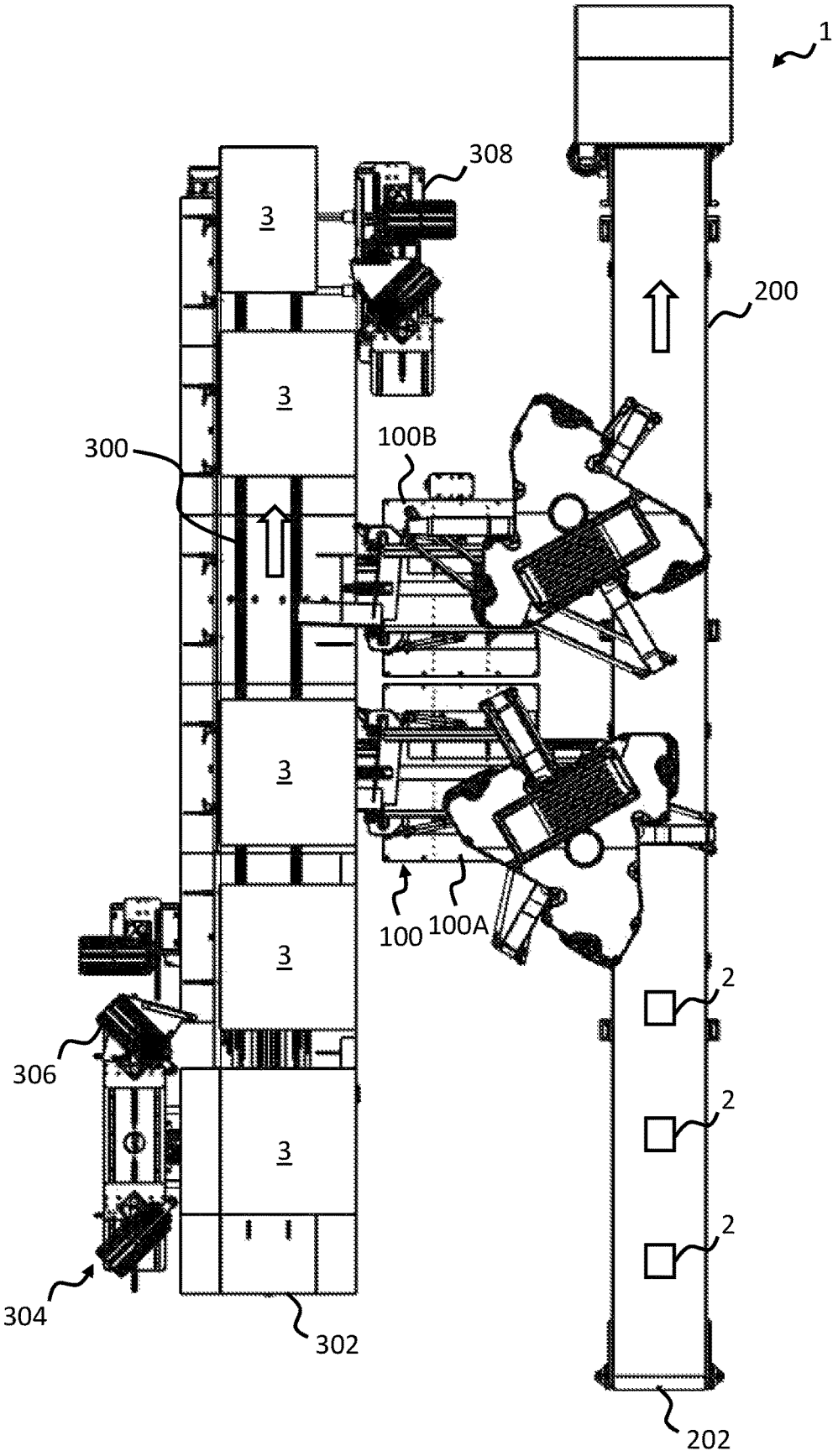
FIG. 1 illustrates an example plan view of a boxing machine.

FIG. 1 illustrates an example plan view of a boxing machine 1.

The boxing machine 1 comprises a product conveyor 200, boxing stations 100 including a first boxing station 100A, a second boxing station 100B, and a box conveyor 300. The boxing stations 100 provide products 2 from the product conveyor 200 to boxes 3 on the box conveyor 300.

The product conveyor 200 may comprise a powered conveyor belt or any other appropriate conveyor.

The product conveyor 200 comprises a product inlet 202 configured to receive products 2 from an upstream process.

The product conveyor 200 extends to the first boxing station 100A which is configured to extract a first set (e.g., approximately half) of products 2 from the product conveyor 200.

The product conveyor 200 extends further to the second boxing station 100B which is configured to extract a second set (e.g., approximately half) of the products 2 from the product conveyor 200.

The second boxing station 100B, if it is the last boxing station, may be configured to extract the remainder of the products 2 from the product conveyor 200.

If any products 2 are missed by both the first and second boxing stations 100A, 100B, the products 2 may fall off an end of the product conveyor 200 into a collection container, or alternatively the product conveyor 200 could recirculate.

As shown, the box conveyor 300 may comprise a powered conveyor. The box conveyor 300 may extend in a direction substantially parallel to the product conveyor 200. The box conveyor 300 may be alongside the product conveyor 200, with the first and second boxing stations 100A, 100B therebetween. The box conveyor 300 may move boxes 3 in the same direction as products 2 moved by the product conveyor 200.

The box conveyor 300 comprises a box inlet 302 configured to receive boxes 3. The boxes 3 entering the product conveyor 200 may be fully or partially unfolded. The boxes 3 are sideways-oriented.

The box conveyor 300 may firstly extend past a base folder 306 of a box 3 folding system 304. The illustrated base folder 306 is configured to fold base flaps of each box 3 into a closed configuration. The base folder 306 may be located upstream of the first boxing station 100A. The base folder 306 may comprise a plurality of actuators, each actuator for folding a different base flap of the box 3.

The box conveyor 300 then extends to the first boxing station 100A which is configured to laterally insert the first set of products 2 into a sideways-oriented box 3. The base of the box 3 may be closed but its top flaps may still be open, leaving a sideways-oriented top opening of the box 3 through which the products 2 can be inserted.

The product conveyor 200 extends further to the second boxing station 100B which is configured to laterally insert the second set of products 2 into the sideways-oriented box 3, to complete a filling of the box 3.

The box 3 then passes along the box conveyor 300 from the second boxing station 100B to a top folder 308 of the box folding system 304. The top folder 308 is configured to fold the top flaps of the box 3 into a closed configuration, to enclose the inserted products 2 within the box 3. The top folder 308 may comprise a plurality of actuators, each actuator for folding a different top flap of the box 3.

Figure 2:
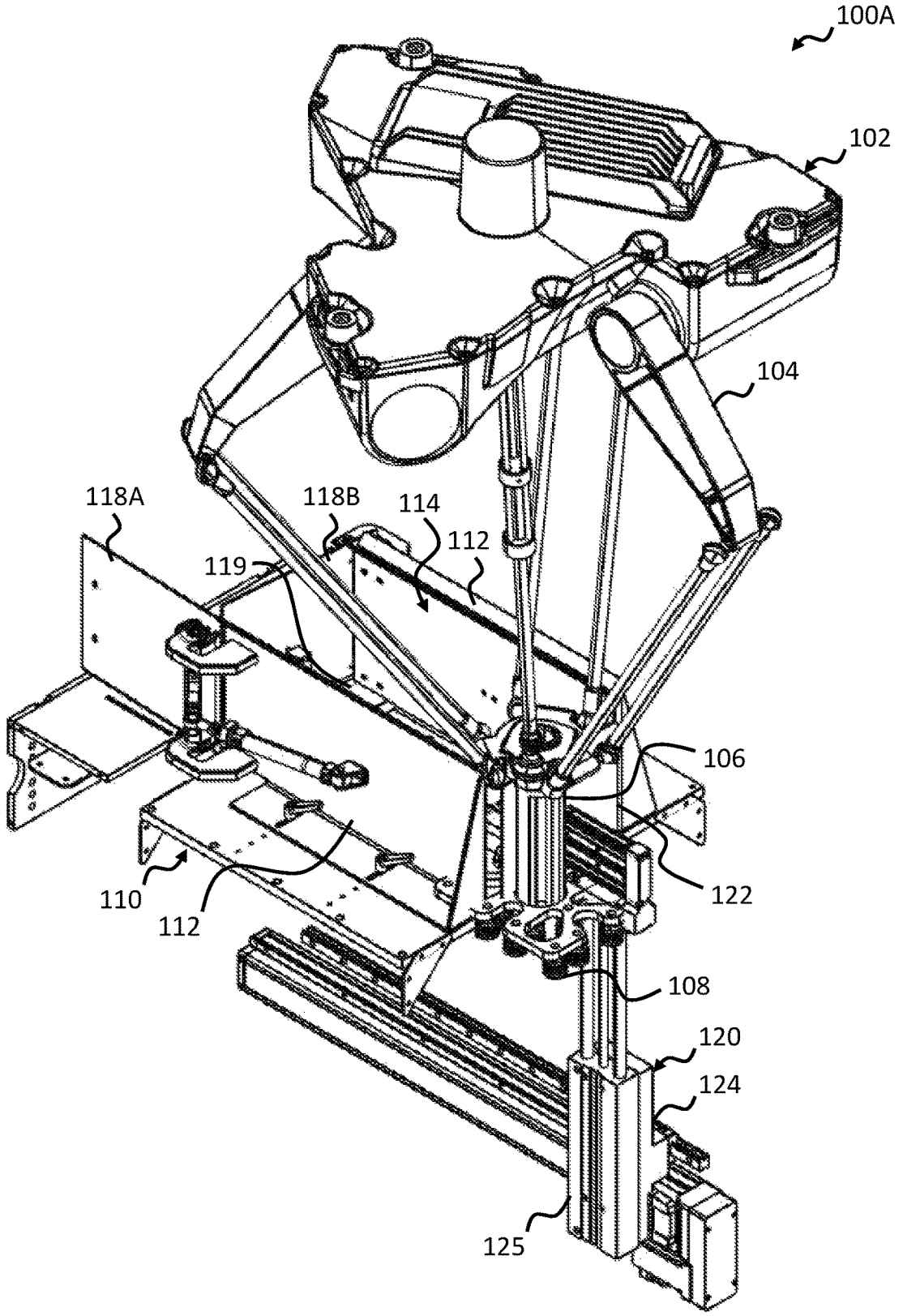
FIG. 2 illustrates a perspective view of an example boxing station.
Figure 3:
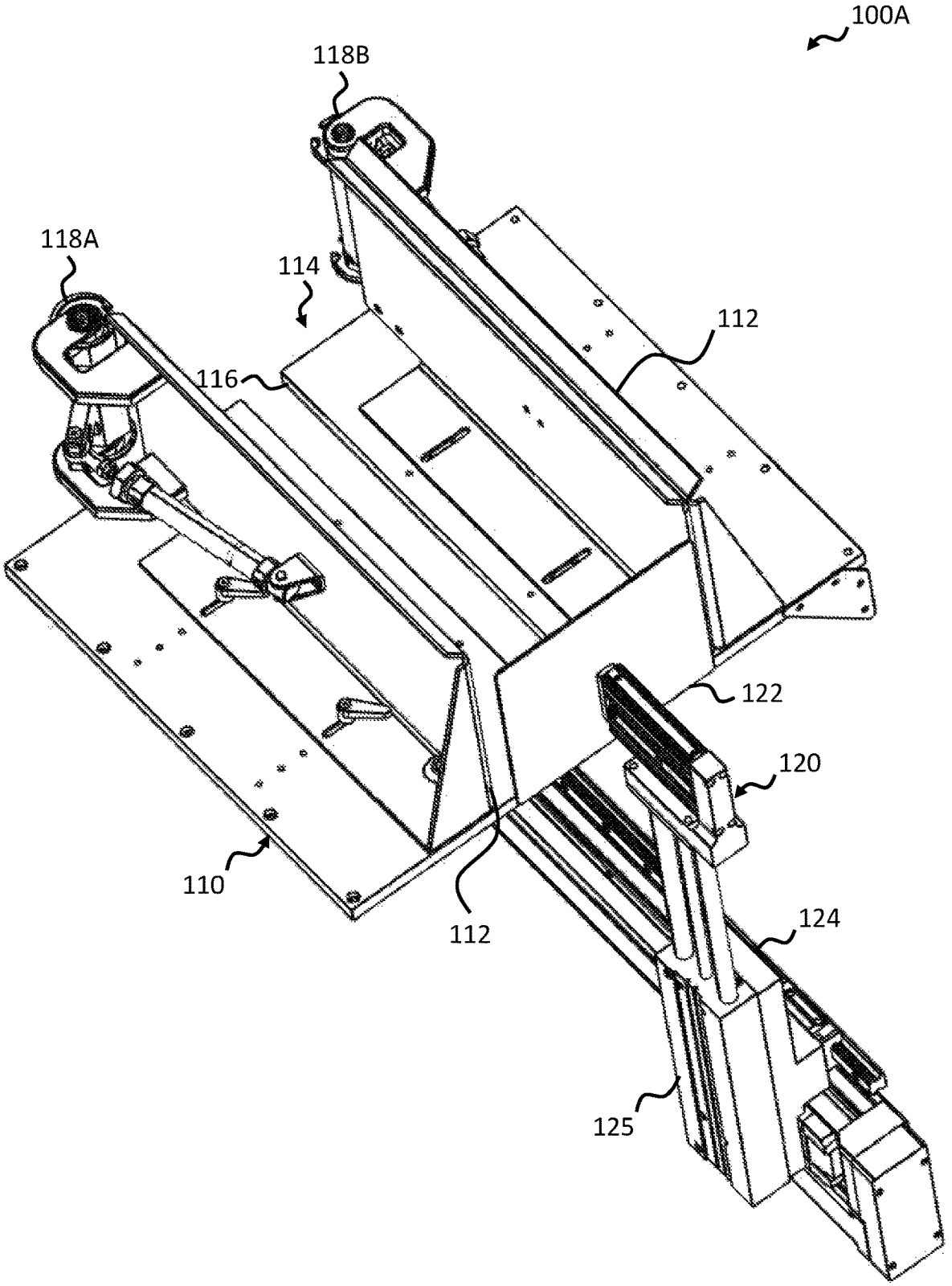
FIG. 3 illustrates an example top perspective view of a product accumulator and an inserter of a boxing station.
Figure 4:
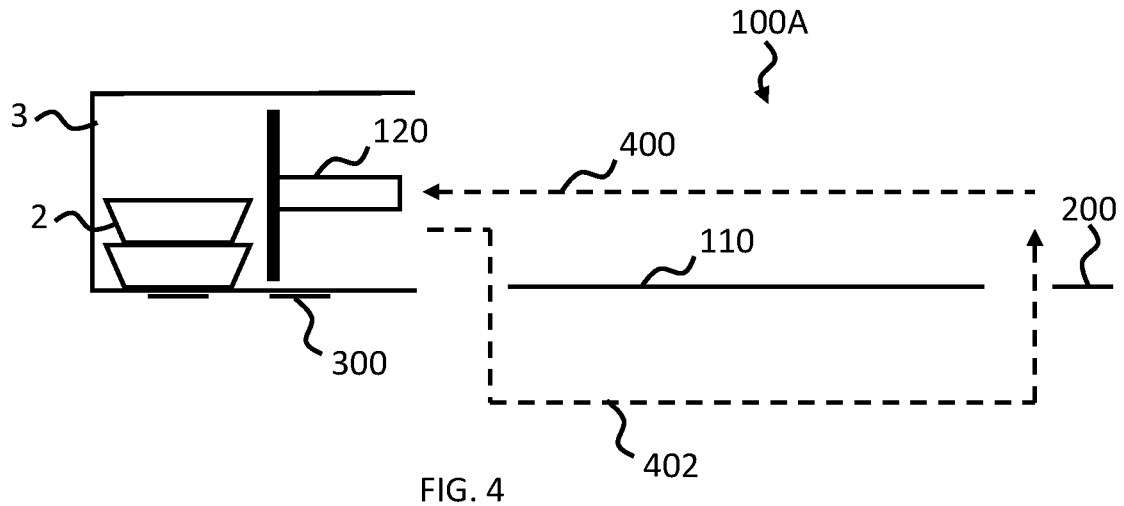
FIG. 4 schematically illustrates example paths of an inserter of a boxing station.

The boxing stations 100 are now described in more detail, with reference to FIGS. 2-4. These Figures illustrate the first boxing station 100A. The second boxing station 100B may have any one or more of the same features as the first boxing station 100A.

The first boxing station 100A may be configured to insert a plurality of accumulated products 2, collectively defining the first set of products 2, into the box 3. To achieve this, the first boxing station 100A comprises a robotic picker 102, a product accumulator 110, and an inserter 120. The robotic picker 102 is configured to deposit products 2 onto the product accumulator 110, and the inserter 120 is configured to insert the accumulated products 2 into the box 3.

The robotic picker 102, shown in FIG. 2, may be configured as a pick and place robot. The robotic picker 102 is configured to automatically detect the positions of products 2 on the product conveyor 200, lift the products 2 from the product conveyor 200, and lower them onto the product accumulator 110. Detection of the products 2 can be achieved by known sensing means, such as a camera.

The illustrated robotic picker 102 comprises a parallel manipulator 104 connected to an end effector arrangement 106 configured to pick products 2 from the product conveyor 200. The robotic picker 102 may be located above the product conveyor 200, between the product conveyor 200 and the product accumulator 110, with the parallel manipulator 104 facing downwards.

The parallel manipulator 104 may comprise three degrees of translational freedom. The end effector arrangement 106 may comprise a degree of rotational freedom, for rotating products 2 about a vertical axis. The parallel manipulator 104 comprises actuating arms arranged in at least a tripod. Each actuating arm may comprise hinge joints such as a shoulder joint and an elbow joint.

The end effector arrangement 106 may be sized to pick a plurality of products 2 at once. The end effector arrangement 106 may comprise a regular or irregular array of end effectors 108. The size of the array depends on how many products 2 are to be picked at once, and the product size. The array can comprise three or more rows and three or more columns of end effectors 108.

The end effector arrangement 106 may be configured to secure a top surface of the product. The end effector arrangement 106 may comprise vacuum means for attaching to the top surface. The vacuum means may comprise an array of vacuum end effectors 108. Alternatively, the end effector arrangement 106 can comprise another effector means.

The illustrated product accumulator 110 comprises a platform between the product conveyor 200 and the box conveyor 300. The robotic picker 102 is configured to assemble the set of products 2 on the product accumulator 110.

The robotic picker 102 may be configured to assemble the set of products 2 by placing a first subset of one or more products 2 on the product accumulator 110. The first subset may comprise a row or a column of products 2.

In some examples, the robotic picker 102 is then configured to pick one or more further products 2 from the product conveyor 200 and place the one or more further products 2 adjacent the already-placed product(s) to extend the row or column or to form an array of at least two rows and at least two columns.

Additionally, or alternatively, the robotic picker 102 is configured to pick one or more additional products 2 from the product conveyor 200 and stack the one or more additional products 2 onto the already-placed product(s). In this example, the assembled set of products 2 is a stack. The assembled set of products 2 may comprise a row of stacked products 2, a column of stacked products 2, or an array of stacked products 2.

The assembled set of products 2 can then be inserted into the box 3 by the inserter 120.

The illustrated inserter 120 is configured to laterally move the respective first or second set of products 2 into the sideways-oriented box 3 (not shown in FIGS. 2-3). The inserter 120 comprises a lateral pusher 122 for pushing the set of products 2 along the product accumulator 110, laterally into the opening of the sideways-oriented box 3. The lateral pusher 122 may be configured to slide the products 2 along the platform surface of the product accumulator 110 and into the box 3. The lateral pusher 122 may comprise a movable upright plate or the like.

If the set of products 2 comprises a stack of products 2, the lateral pusher 122 may be sized so that the inserter 120 functions as a stack inserter configured to insert the entire stack of products 2 into the box 3 at once (e.g., in one movement).

If the set of products 2 comprises a row, column or array of stacked products 2, the lateral pusher 122 may be sized so that the inserter 120 functions as a multiple-stack inserter configured to insert multiple adjacent stacks of products 2 into the box 3 at once.

The inserter 120 further comprises an actuator arrangement 124 configured to move the lateral pusher 122. An example cyclic motion path of the lateral pusher 122 is shown in FIG. 4.

As shown in FIG. 4, the actuator arrangement 124 of the inserter 120 is configured to move the lateral pusher 122 from a starting position towards the box 3 in a first path 400. The starting position of the first path 400 is proximal to the product conveyor 200. The first path 400 extends through a placing location of the robotic picker 102. The first path 400 may terminate proximal to the box conveyor 300. The first path 400 may comprise a linear and/or approximately horizontal path.

The first path 400 may terminate inside an envelope of the box 3. The lateral pusher 122 may move through the opening of the open top flaps of the box 3. This ensures that the set of products 2 is pushed to the base of the sideways-oriented box 3.

The actuator arrangement 124 of the inserter 120 is then configured to return the lateral pusher 122 to the starting position in preparation for a next boxing cycle.

The actuator arrangement 124 may comprise an additional degree of freedom, so that the return path (second path 402) of the lateral pusher 122 is different from the first path 400. This enables the lateral pusher 122 to bypass the placing location of the robotic picker 102, so that the robotic picker 102 can assemble the set of products 2 for the next boxing cycle before the lateral pusher 122 has completed returning to the starting position.

The second path 402 may first comprise reversing the lateral pusher 122 out of the box 3, in examples in which the first path 400 terminated inside the box 3.

The second path 402 then comprises a bypass portion extending around the placing location of the robotic picker 102. The bypass portion of the second path 402 may be vertically and/or laterally offset relative to the first path 400.

In the example of FIG. 4, the bypass portion of the second path 402 is vertically offset from the first path 400. In the illustrated implementation, the bypass portion of the second path 402 is below the first path 400.

The illustrated bypass portion of the second path 402 is below the product accumulator 110 whereas the first path 400 is on (above) the product accumulator 110. Once the placing location has been passed, the lateral pusher 122 can be lifted to the starting position.

In order to facilitate the first path 400 and the second path 402 of FIG. 4, the actuator arrangement 124 of the inserter 120 can comprise two degrees of translational freedom. These comprise a horizontal degree of freedom and a vertical degree of freedom. As shown in FIGS. 2-3, the actuator arrangement 124 may comprise a horizontally slidable carriage 125 to enable the horizontal degree of freedom. The carriage 125 may comprise a vertically-movable output configured to change a vertical separation of the lateral pusher 122 from the carriage 125, to enable the vertical degree of freedom.

The actuator arrangement 124 and the lateral pusher 122 may be located to opposite sides of the product accumulator 110. Therefore, in order to prevent interference between the actuator arrangement 124 and the product accumulator 110, the product accumulator 110 may comprise a slot 116 as shown in FIG. 3. The path of the slot 116 depends on the direction of the first path 400 of the lateral pusher 122. The slot 116 may be linear and extends towards the box conveyor 300. The width of the slot 116 may be narrow enough that products 2 on the product accumulator 110 do not fall through the slot 116.

FIGS. 2 and 3 also illustrate the product accumulator 110 comprising guide portions 112 for constraining the set of products 2 to a channel 114 while the set of products 2 is being inserted into the box 3. The illustrated guide portions 112 comprise side guide portions such as side walls. The guide portions 112 may comprise a guide portion 112 to each side of the slot 116. The width separation of the guide portions 112 depends on the width of the set of products 2 and/or the dimensions of the box 3. The width separation may be adjustable.

FIG. 2 also illustrates deployable top flap holders 118A, 118B configured to hold open the top flaps of the box 3 while the products 2 are inserted into the box 3. The top flap holders 118A, 118B can comprise a first top flap holder 118A for holding open a first top flap of the box 3 and a second top flap holder 118B for holding open a second top flap of the box 3.

The top flap holders 118A, 118B may each comprise a hinged member. The hinged members may be mounted to the guide portions 112 of the product accumulator 110. The hinged members may be swung open in opposite directions by their respective actuators, to engage with top flaps of the box 3 to hold the top flaps open.

In some examples, each top flap holder 118A, 118B also comprises a floor portion 119, so that when the top flap holders 118A, 118B are swung open the floor portions 119 create a bridge between the product accumulator 110 and the box 3.

Once the operation of the first boxing station 100A is complete, the box 3 moves downstream along the box conveyor 300 from the first boxing station 100A to the second boxing station 100B, until the box 3 is aligned with the second boxing station 100B, and then the second boxing station 100B inserts the second set of products 2 into the box 3 that already contains the first set of products 2. As mentioned previously, the second boxing station 100B may comprise the same features as the first boxing station 100A. Some differences of the second boxing station 100B are described below.

Figure 5:
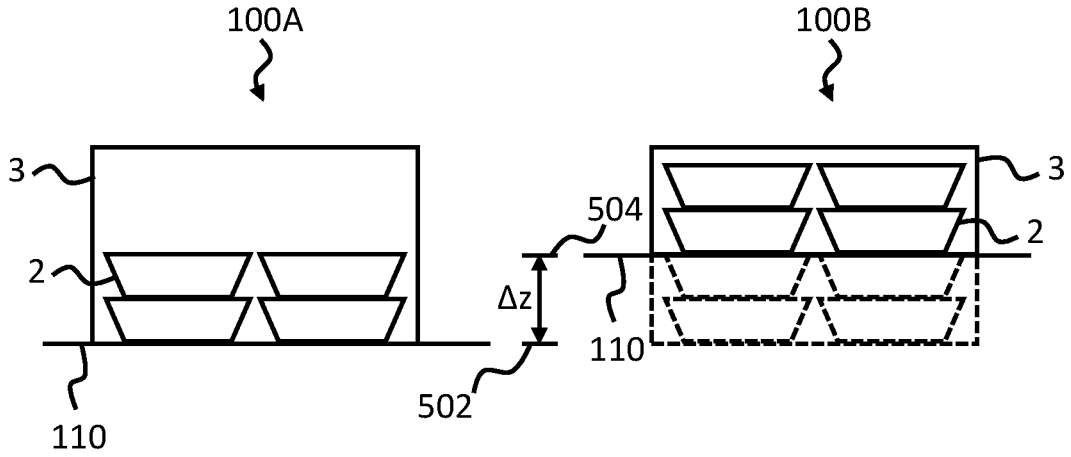
FIG. 5 schematically illustrates first and second boxing stations being configured for different product insertion heights.

Referring to FIG. 5, the second boxing station 100B can be configured to stack the second set of products 2 onto the first set of products 2 within the sideways-oriented box 3. The second set of products 2 then rests on the first set of products 2 within the sideways-oriented box 3 (i.e., the sets of products 2 are side-by-side when the box 3 is upright). In order to facilitate stacking of the second set of products 2 on the first set of products 2, a product insertion height 504 of the second boxing station 100B may be higher than a product insertion height 502 of the first boxing station 100A.

The product insertion height 502, 504 may be defined, at least in part, by the height of the product accumulator 110. The difference in product insertion heights 502, 504 may be configurable by an operator, to suit the product and box dimensions. The inserter 120 and the robotic picker 102 may be height-adjustable.

Figure 6:
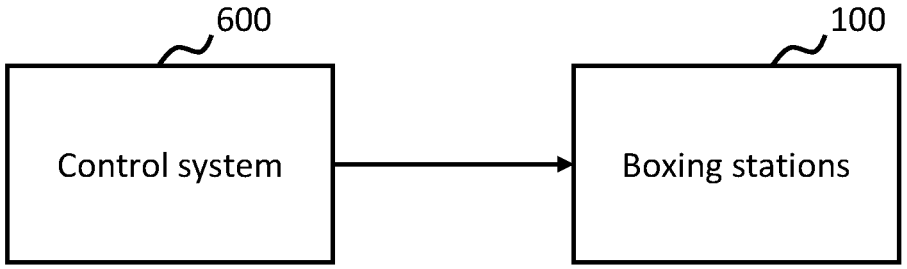
FIG. 6 schematically illustrates an example a control system for a boxing station.

FIG. 6 schematically illustrates an example of a control system 600. The control system 600 may control various functions of the boxing stations 100. Some control aspects are known or outside the scope of this disclosure.

The control system 600 may comprise one or more controllers. The controllers may belong to the separate actuators/robots and there may or may not be a central controller for centrally controlling functions of the boxing machine 1. Each controller may comprise a processor, memory and computer program code.

The control system 600 may be configured to enable the split filling of the box 3. This includes, for example, controlling the robotic picker 102 of the first boxing station 100A to pick a subset of the products 2 on the product conveyor 200, so that some products 2 pass through to the second boxing station 100B.

In some use cases, the proportions of products 2 picked by the first boxing station 100A and the second boxing station 100B may be split approximately 50/50.

In some examples, an operator may wish to fill a box 3 with an odd number of products 2. This means that one boxing station (e.g., first boxing station 100A) will pick, place and insert an additional product compared to the other boxing station (e.g., second boxing station 100B). As a result, the second boxing station 100B would dwell as it waits for the first boxing station 100A to complete. In order to avoid dwell, the control system 600 may be configured in an 'odd filling' configuration.

In the odd filling configuration, the control system 600 may be configured to alternate which one of the boxing stations 100 picks an additional product. In other words, the control system 600 selects alternating ones of the first boxing station 100A and the second boxing station 100B, for each boxing cycle, to provide the additional product (the odd-numbered product) to each successive box 3.

Although embodiments of the present invention have been described in the preceding paragraphs with reference to various examples, it should be appreciated that modifications to the examples given can be made without departing from the scope of the invention as claimed. Although the illustrated embodiment enables filling of up to 20 boxes per minute/insertion of up to 120 products per minute, speed and/or precision may not be as important in some implementations. For example:

- the robotic picker 102 could be replaced with a different means for transferring a product to the product accumulator 110, such as a pusher or any other appropriate means;
- the inserter 120 could be replaced with a different means for transferring a product to a box 3, such as a product accumulator tilting device or any other appropriate means.
- the robotic picker 102 and the inserter 120 could be merged into a single device for transferring products 2 from the product conveyor 200 to the box 3, optionally without a product accumulator 110.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A boxing machine comprising:

a first boxing station;

a second boxing station;

a product conveyor extending from a product inlet to the first boxing station and from the first boxing station to the second boxing station; and a box conveyor extending from a box inlet to the first boxing station and from the first boxing station to the second boxing station, wherein the first boxing station is configured to insert a first set of products from the product conveyor to a sideways-oriented box on the box conveyor, and wherein the second boxing station is configured to insert a second set of products to the sideways-oriented box on the box conveyor.

2. The boxing machine of claim 1, wherein the first boxing station is configured to insert a plurality of accumulated products, collectively defining the first set of products, into the sideways-oriented box, and wherein the second boxing station is configured to insert a plurality of accumulated products, collectively defining the second set of products, into the sideways-oriented box.

3. The boxing machine of claim 1, wherein the second boxing station is configured to stack the second set of products onto the first set of products within the sideways-oriented box.

4. The boxing machine of claim 3, wherein a product insertion height of the second boxing station is higher than a product insertion height of the first boxing station, so that when the box is sideways-oriented the second set of products is stacked on the first set of products and when the box is upright-oriented the second set of products is alongside the first set of products.

5. The boxing machine of claim 1, wherein each boxing station comprises a robotic picker, wherein the robotic picker comprises an end effector arrangement configured to pick products from the product conveyor, and wherein the end effector arrangement is sized to pick a plurality of products at once.

6. The boxing machine of claim 5, wherein the robotic picker comprises a parallel manipulator.

7. The boxing machine of claim 5, wherein each boxing station comprises a product accumulator, wherein the product accumulator comprises a platform between the product conveyor and the box conveyor.

8. The boxing machine of claim 7, wherein the robotic picker is configured to pick at least one product from the product conveyor and place the at least one product on the product accumulator, and wherein the robotic picker is configured to assemble the respective first or second set of products on the product accumulator.

9. The boxing machine of claim 8, wherein the robotic picker is configured to pick one or more further products from the product conveyor and place the one or more further products adjacent the placed at least one product to form an array or a row or a column.

10. The boxing machine of claim 9, wherein the robotic picker is configured to stack additional products on the array or row or column, such that the first set of products is a stack and the second set of products is a stack.

11. The boxing machine of claim 1, wherein each boxing station comprises an inserter configured to laterally move the respective first or second set of products into the sideways-oriented box.

12. The boxing machine of claim 11, wherein the inserter is configured as a stack inserter configured to insert an entire stack of products into the sideways-oriented box in one movement.

13. The boxing machine of claim 12, wherein the inserter is configured as a multiple-stack inserter configured to insert multiple adjacent stacks of products into the sideways-oriented box at once.

14. The boxing machine of claim 11, wherein the inserter is configured to slide the respective first or second set of products into the sideways-oriented box.

15. The boxing machine of claim 11, wherein the inserter is configured to move from a starting position towards the sideways-oriented box in a first path and then to return to the starting position in a second path bypassing a placing location of the robotic picker.

16. The boxing machine of claim 11, wherein each boxing station comprises a robotic picker, wherein the robotic picker comprises an end effector arrangement configured to pick products from the product conveyor, wherein the end effector arrangement is sized to pick a plurality of products at once, wherein each boxing station comprises a product accumulator, wherein the product accumulator comprises a platform between the product conveyor and the box conveyor, and wherein the inserter is configured to move within a channel defined by the product accumulator.

17. The boxing machine of claim 1, comprising a control system, wherein the control system is configured to control filling of boxes with an odd number of products, wherein in said configuration, the control system is configured to select alternating ones of the first boxing station and the second boxing station, for each boxing cycle, to provide an additional product to each successive sideways-oriented box.

18. The boxing machine of claim 1, wherein the boxing machine comprises a box folding system configured to fold a base of the box upstream of the first boxing station and configured to fold a top of the box downstream of the second boxing station.

19. The boxing machine of claim 1, wherein the product conveyor and the box conveyor are substantially parallel to each other, arranged such that an opening of the sideways-oriented box faces the product conveyor in use.

* * * * *